US005950717A

United States Patent [19]

Fay

[11] Patent Number: 5,950,717

[45] Date of Patent: Sep. 14, 1999

[54] AIR-COOLED SURFACE CONDENSER

[75] Inventor: Herman Peter Rolf Fay, Solana Beach, Calif.

[73] Assignee: GEA Power Cooling Systems Inc., San Diego, Calif.

[21] Appl. No.: 09/058,321

[22] Filed: Apr. 9, 1998

[51] Int. Cl.[6] ..... F28B 9/10

[52] U.S. Cl. ..... 165/113; 165/111; 165/DIG. 222

[58] Field of Search ..... 165/111, 112, 165/113, 114

[56] References Cited

U.S. PATENT DOCUMENTS

| | | | |
|---|---|---|---|
| 3,612,172 | 10/1971 | Dohnt | 165/111 |
| 4,177,859 | 12/1979 | Gatti et al. | 165/113 X |
| 5,653,281 | 8/1997 | Berg et al. | 165/113 |

*Primary Examiner*—Leonard Leo

*Attorney, Agent, or Firm*—Friedrich Kueffner

[57] ABSTRACT

An air cooled condenser is provided which improves the heat transfer in the dephlegmator pipes and reduces the risk of condensate back-up. A condensate outlet extending from the bottom end to the top is arranged in selected dephlegmator pipes. The cross section and the geometry of the condensate outlet is configured in accordance with the respective cross section geometry and the dimensions of the dephlegmator pipe. The length of the condensate outlet is preferably between 100 mm and 500 mm. By separating the steam phase and the condensate phase at the entrance to the dephlegmator pipes, a mutual disadvantageous influence of the two phases on each other is prevented. In particular, the frictional forces between the steam and condensate can be appreciably reduced. As a result, the back-up velocity, that is, the steam inlet velocity at which the condensate starts to back up, is appreciably reduced. Depending on the length of the condensate outlets, a condensate back-up or swallowing can be prevented entirely.

8 Claims, 6 Drawing Sheets

AIR-COOLED SURFACE CONDENSER

FIELD OF THE INVENTION

The invention is directed to an air-cooled surface condenser.

BACKGROUND OF THE INVENTION

The use of air for condensation of turbine steam is a proven and frequently used practice. In the case of direct air condensation, the turbine steam is condensed in ribbed pipe elements connected in parallel and the condensate is returned to the feed water circuit. The ribbed pipe elements are under vacuum internally, wherein the noncondensable gases are sucked out. The flow of cooling air is generally generated by means of ventilators and, more rarely, by means of natural ventilation.

The surface condensers are typically constructed in a roof-type construction (A-arrangement), as it is called, with diagonally arranged cooling pipes. In this case, the cooling pipes form the sides of a triangle at whose base are arranged ventilators. As a rule, the cooling pipes are combined in groups or rows. In so doing, cooling pipes in condenser operation and cooling pipes in dephlegmator operation are often coupled.

In cooling pipes in condenser operation (condenser pipes), the condensate flows in the direction of the steam guided through the cooling pipes (parallel flow condenser), whereas in cooling pipes in dephlegmator operation (dephlegmator pipes), the condensate flows in the opposite direction to the steam (countercurrent condenser). The cooling pipes in dephlegmator operation serve in particular to counter the risk of freezing.

The combination of parallel flow condensers and countercurrent condensers is known in the art, for example, from DE-PS 1 188 629.

In this case, dephlegmator pipes are connected downstream of the condenser pipes. At the same time, they are divided by groups into cooling sectors in such a way that at least a portion of the groups connected in condenser operation can be switched off on the air side in the winter months when operating under partial load and at outside temperatures below freezing in order to precipitate the steam predominantly in the groups connected in dephlegmator operation. Although countercurrent condensers have a poorer efficiency than the parallel flow condensers, they have the advantage that they do not freeze even under partial loading due to the continual contact between the downward running condensate and the upward flowing steam.

The so-called condensation end of the steam is accordingly located in the countercurrent condenser, so that an undercooling of the condensate is prevented in general. Regulation is carried out in this case by switching off individual cooling sectors or by changing the flow of cooling air.

DE 28 45 181 A1 discloses a surface condenser in which a portion of the cooling pipes has an inner dividing wall. In this way, two channels are formed in the cooling pipe, one of which serves for the conduction of steam and the flowing off of the condensate, while the other serves to suck out air and other noncondensable components.

It is further known in the art from the brochure by the Hamon company, "Vacuum Steam Air Condenser—The H. S. Integrated System", to arrange condenser pipes and dephlegmator pipes in a pipe bundle. In this case, the condenser pipes are arranged in the first rows of pipes and the dephlegmator pipes are arranged in a row of pipes which is connected downstream on the air side.

In the dephlegmator pipes, the steam flows in from below and is precipitated in the counterflow to form condensate which runs off downward. As was already mentioned, this has the advantage for operation that the condensate is always maintained approximately at the equilibrium temperature by the steam and an undercooling and the risk of freezing are therefore prevented.

However, in practical operation this dividing up has the disadvantage that the steam velocity is very high particularly in the case of long dephlegmator pipes which have economical advantages because of the large amount of condensable steam in every dephlegmator pipe. This hinders the running off of condensate. This can lead to a condensate back-up or swallowing in the dephlegmator pipes. This swallowing occurs when the steam velocities on entering the dephlegmator pipes are so high that they carry out a screen-like or buffer-like retention of the condensate flowing off in the counterflow or, in some cases, push the condensate upward. This leads to the formation of a water plug which runs downward in a gushing manner when a maximum load is exceeded. This impairs the condensation performance of a surface condenser. In particular, the swallowing results in large pressure losses and in pressure fluctuations in the surface condenser with detrimental effects on operation.

It has been demonstrated that the most difficult operating conditions exist at the pipe entrance to the dephlegmator pipes, where steam and condensate flow against one another. The pipe entrance is also the narrowest point with the highest steam velocity and the highest condensate velocity. Moreover, the gas flow at the pipe entrance is disrupted because of the transition into the dephlegmator pipes with the consequent flow bottleneck. This increases the influence of friction on the condensate running off and increases the tendency toward back-up. Farther up in the dephlegmator pipe, the steam velocity becomes more homogeneous and decreases. Consequently, the friction resistance also decreases.

SUMMARY OF THE INVENTION

An object of the invention is to improve the heat transfer in the dephlegmator pipes of a surface condenser and to reduce the risk of condensate back-up, so as to achieve uniform loading of the dephlegmator pipes and so that the overall efficiency of a surface condenser can be increased.

In accordance with the present invention, a condensate outlet extending from the bottom end to the top is arranged in the dephlegmator pipe or in every dephlegmator pipe.

The essential idea of the invention consists in the step whereby the steam phase and the condensate phase are separated from one another at the entrance to the dephlegmator pipes. In this way, a mutual disadvantageous influence of the two phases on each other is prevented. In particular, the frictional forces between the steam and condensate can be appreciably reduced. As a result, the back-up velocity, that is, the steam inlet velocity at which the condensate starts to back up, is appreciably reduced. Depending on the length of the condensate outlets, a condensate back-up or swallowing can be prevented entirely.

The cross section and the geometry of a condensate outlet is configured in accordance with the respective cross section geometry and the dimensions of a dephlegmator pipe. The length of a condensate outlet is advisably at most half as long as a dephlegmator pipe. In practice, however, the condensate outlet can also be distinctly shorter than half of the length of the dephlegmator pipe because the highest shearing forces between the steam and condensate occur in the lower region of a dephlegmator pipe. The length of the condensate outlet is preferably between 100 mm and 500 mm.

According to another aspect of the Invention, the condensate outlet has, at its lower end, a runoff projecting into the steam-distributor and condensate-collecting chamber.

The condensate runoff is preferably nose-shaped and is directed downward into the steam-distributor and condensate-collecting chamber in such a way that the condensate can run off at the entrance of a dephlegmator pipe so as to be unimpeded by the flow of steam. The condensate exit is accordingly shifted to a region of the steam-distributor and condensate-collecting chamber at which the prevailing steam velocity is only small in comparison with the steam velocities at the pipe entrance.

The cross section geometry of a runoff can have different configurations, for example, round, rectangular, or triangular, in conformity to the respective geometry of a condensate outlet. The runoff is configured in such a way that the condensate can run off so as to be shielded from the steam.

Since the condensate flows off along the lower longitudinal side of a dephlegmator pipe in all dephlegmator pipes which are arranged at an inclination, it is provided in accordance with another aspect of the invention that the condensate outlet is also arranged on the lower longitudinal side of a dephlegmator pipe. In the case of a downward runoff, the condensate enters the condensate outlet and flows separately from the upward flowing steam. In this way, the condensate is effectively removed from the frictional influence of the steam.

According to another aspect of the invention, the condensate outlet has at least one pipe which is integrated or incorporated into the dephlegmator pipe.

In accordance with another aspect of the invention, a particularly advantageous embodiment form, especially when oval or rectangular dephlegmator pipes are used, consists in forming the condensate outlet from two pipes of different length, the shorter of the two pipes being arranged below the longer pipe.

The two pipes are connected with one another to form a pair of pipes. For this purpose, they can be joined in a great many ways, for example, by welding, soldering, or clamping.

The length of the upper pipe preferably corresponds approximately to half of the length of a dephlegmator pipe. The diameter of the upper pipe and lower pipe can be identical or can have different dimensions.

The shorter, lower pipe contacts the dephlegmator pipe in the lower longitudinal portion, the upper pipe extends farther upwards and likewise contacts the dephlegmator pipe. The condensate coming from the upper region of a dephlegmator pipe then flows down through the upper pipe. The condensate coming from the lower region of the dephlegmator pipe is conducted off over the lower pipe. In the region between the inlet opening of the upper pipe and the inlet opening of the lower pipe, the condensate runs off in the gap under the upper pipe at the wall of the dephlegmator pipe. In this location, it is extensively protected against the friction of the steam flow. In the course of its downward path, the condensate reaches the lower pipe and is guided off.

According to another aspect of the invention, a further advantageous embodiment form of the general inventive idea consists in that the condensate line is formed by a dividing wall which is incorporated in the dephlegmator pipe. This embodiment form results in advantages particularly when using round dephlegmator pipes. The construction is simple and economical. Assembly can also be carried out in an automated manner.

According to another aspect of the invention, recesses for the passage of condensate are advisably provided in the dividing wall so as to be distributed along the length. In this way, a continuous discharge of condensate is ensured. The recesses can be formed, for example, by bore holes or punched openings.

In its entirety, the condensate discharge, proposed in accordance with the invention, in the dephlegmator pipe results in an improvement in the heat transfer in the dephlegmator pipes of a surface condenser. Disadvantageous mutual influencing of the upward flowing steam and the downward flowing condensate is prevented. The risk of a condensate back-up in the dephlegmator pipes is reduced. A uniform loading of the dephlegmator pipes can be achieved accompanied by an increase in the condensation output. The risk of pressure losses or pressure fluctuations and their disadvantageous consequences for turbine operation are considerably reduced.

The invention is described more fully in the following with reference to embodiment examples shown in the drawings.

DESCRIPTION OF THE PREFERRED EMBODIMENTS

Figure 1:
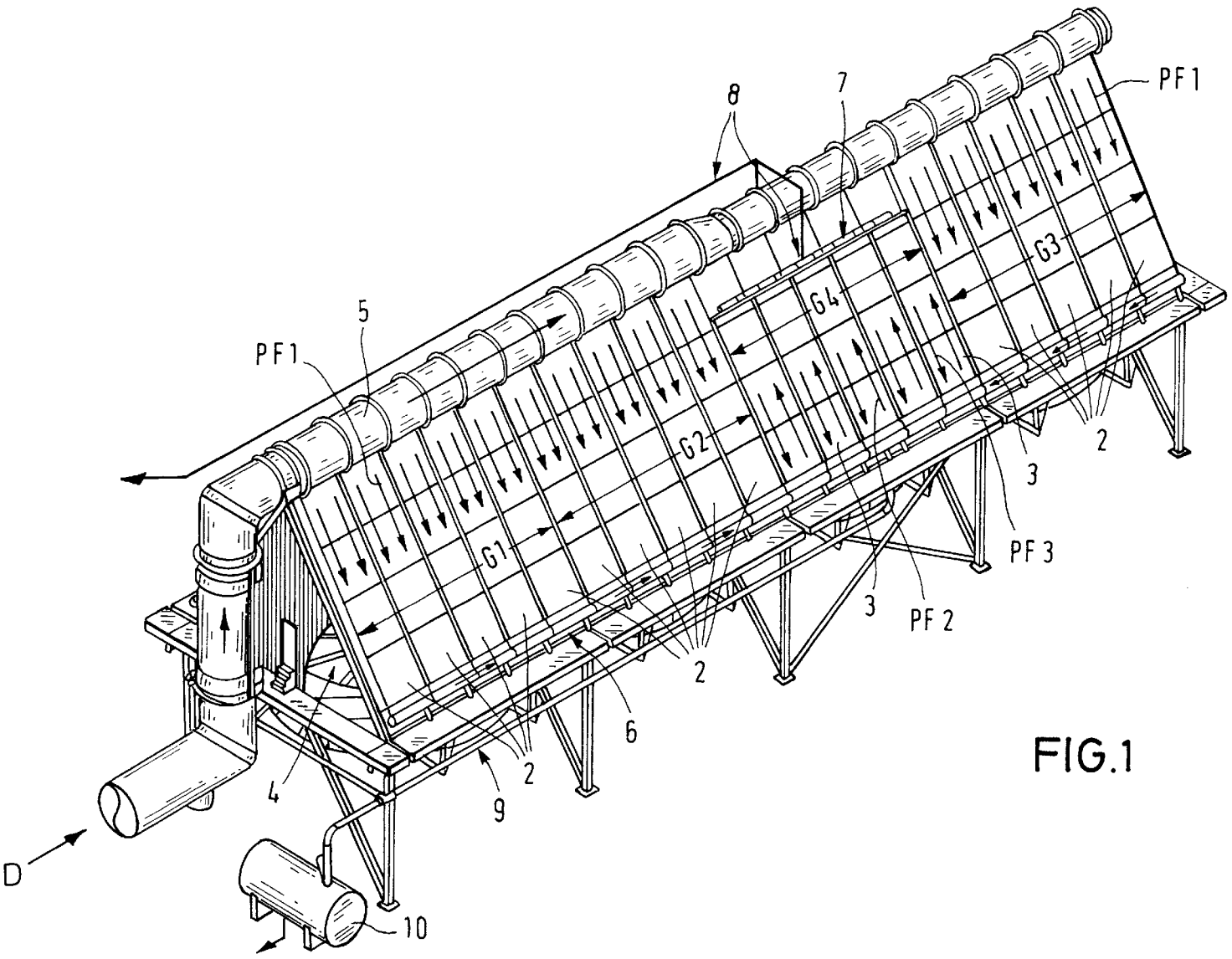
FIG. 1 shows an isometric view of a surface condenser with a combination of parallel flow condensers and countercurrent condensers.

FIG. 1 is an isometric view showing an air-cooled surface condenser 1. Usually, a plurality of surface condensers 1 are arranged next to one another within an installation, wherein every surface condenser 1 is acted upon in parallel by exhaust steam.

A typical surface condenser 1 is formed of three groups G1, G2, G3 of ribbed pipe elements 2 connected in condenser operation (parallel flow condensers) and a group G4 with ribbed pipe elements 3 which is connected in dephlegmator operation (countercurrent condenser). Ventilators 4 which generate the flow of cooling air are located below the ribbed pipe elements 2, 3.

Exhaust steam D flows from a turbine via the distributor line 5 to the ribbed pipe elements 2 connected in condenser operation. The exhaust steam flows downward out of the distributor line 5 (arrow direction PF1) in the ribbed pipe elements 2 and condenses. A condensate collecting line 6 is arranged at the lower end of the ribbed pipe elements 2. The exhaust steam which has not yet condensed also arrives in the condensate collecting line 6. This exhaust steam is transported over the condensate collecting line 6 to the ribbed pipe elements 3 connected in dephlegmator operation and is introduced into the dephlegmator pipes from below (arrow direction PF2). The upward flowing exhaust steam is guided opposite to the downward flowing condensate (arrow direction PF3). The condensate collecting line 6 accordingly also functions as a steam distributor chamber for dephlegmator pipes. It is therefore designated in its entirety hereinafter as steam-distributor and condensate-collecting chamber 6.

A gas collector 7 is located at the upper end of the ribbed pipe elements 3. The noncondensable gases enter the gas collector 7 and are guided off via the pipe line 8.

All of the condensate occurring in the ribbed pipe elements 2 and 3 connected in condenser operation and in dephlegmator operation, respectively, is collected in the steam-distributor and condenser-collecting chamber 6 and reaches a condensate collecting tank 10 via the pipeline 9. Proceeding from there, the condensate reaches the feed water circuit again.

Figure 2:
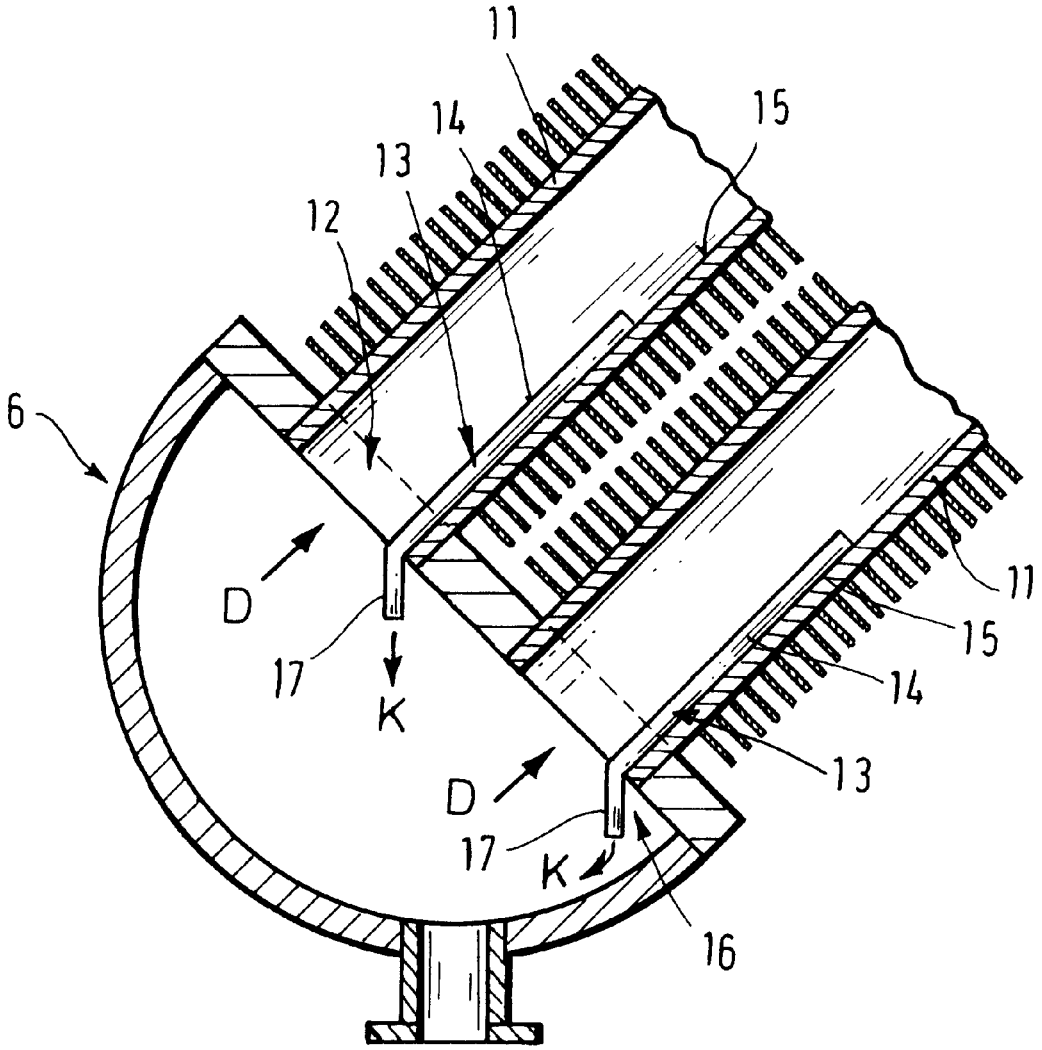
FIG. 2 shows a section from the region of a countercurrent condenser on the steam distributor side in vertical cross section.

FIG. 2 shows a vertical cross-sectional view of a section from the lower region of the countercurrent condenser according to FIG. 1. The steam-distributor and condensate-collecting chamber 6 with two dephlegmator pipes 11 that open into the latter and are ribbed on the outside can be seen.

A condensate outlet 13 extends from the lower end 12 upward into the dephlegmator pipes 11. The condensate flow is accordingly channeled in the dephlegmator pipe 11 and is removed from the influence of the upward flowing steam D.

The condensate outlet 13 comprises a pipe 14 which is arranged on the lower longitudinal side 15 of the dephlegmator pipe 11. At its lower end 16, the condensate outlet 13 has a nose-like runoff 17 which projects into the steam-distributor and condensate-collecting chamber 6 and is bent vertically downward.

The condensate K is conducted over the runoff 17 into a region of the steam-distributor and condensate-collecting chamber 6 in which the steam velocities are lower than at the entrance into the dephlegmator pipes 11 and the flows are accordingly less turbulent. The steam inlet into the dephlegmator pipe 11 and the condensate exit from the dephlegmator pipe 11 are separated from one another by the condensate outlet 13.

Figure 3:
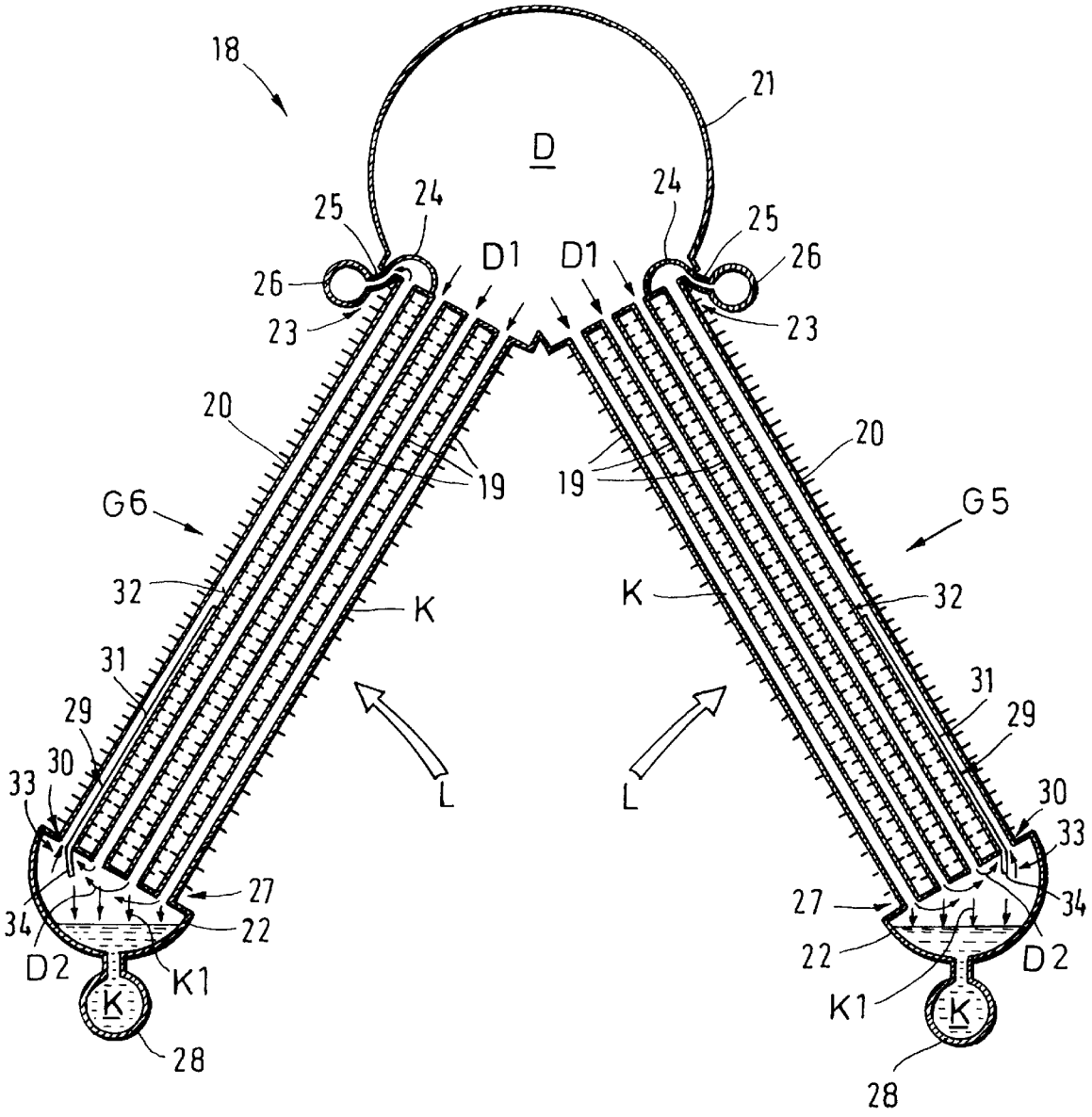
FIG. 3 is a schematic view showing a vertical cross section through another embodiment form of an air-cooled surface condenser.

The air-cooled surface condenser 18 shown schematically in FIG. 3 is a component part of a heat exchanger installation. This heat exchanger installation serves to remove condensation from steam, e.g., in a power plant.

The surface condenser 18 has two groups G5, G6 which are arranged in an A-shaped manner relative to one another and have ribbed cooling pipes 19, 20 which lie parallel to one another. Cooling air L flows against the cooling ribs 19, 20 from below.

The cooling pipes 19 are connected in condenser operation (condenser pipes), whereas the cooling pipes 20 are connected in dephlegmator operation (dephlegmator pipes).

The condenser pipes 19 extend between an upper steam distributor chamber 21 and a condensate collecting chamber 22 located at the bottom, which is simultaneously the steam distributor chamber for the dephlegmator pipes 20.

At their upper ends 23, the dephlegmator pipes 20 open into an outlet chamber 24 which is sealed relative to the steam distributor chamber 21. This outlet chamber 24 is connected to a gas discharge 26 via a connection line 25.

Steam D flows from a turbine along the steam distributor chamber 21 to the condenser pipes 19. In the condenser pipes 19, the steam flows downward out of the steam distributor chamber 21 (arrow D1) and condenses. The condensate K enters the steam-distributor and condensate-collecting chambers 22 at the bottom end 27 of the condenser pipes 19 (arrows K1).

The steam which has not yet condensed also reaches the steam-distributor and condensate-collecting chambers 22. This steam is deflected therein and enters the dephlegmator pipes 20 from below (arrow D2). The steam rises in the dephlegmator pipes 20 and condenses due to the continuous delivery of heat. The condensate then runs downward opposite to the upward flowing steam.

The occurring air and other noncondensable gas components are sucked out by a vacuum system, not shown, over the exit chamber 24, connection line 25 and gas discharge 26.

All of the condensate K occurring in the condenser pipes 19 and in the dephlegmator pipes 20 is collected in the steam-distributor and condensate-collecting chambers 22 and returned via pipe lines 28 to a condensate collection tank. From the latter, the condensate K reaches the feed water circuit again.

A condensate outlet 29 extends from the lower end 30 up into the dephlegmator pipes 20. The occurring condensate K can run off via the condensate outlet 29 so as to be separated from the upward flowing steam D. In this case, also, the condensate outlet 29 includes a pipe 31 at the lower longitudinal side 32 of the dephlegmator pipe 20. The condensate outlet projects into the steam-distributor and condensate-collecting chambers 22 by its runoff 34 which is arranged at the lower end 33. The runoff 34 is bent downward vertically. The condensate K exits via the runoff 34 without being disadvantageously influenced by the upward flowing steam D in the dephlegmator pipe 20.

Figure 4:
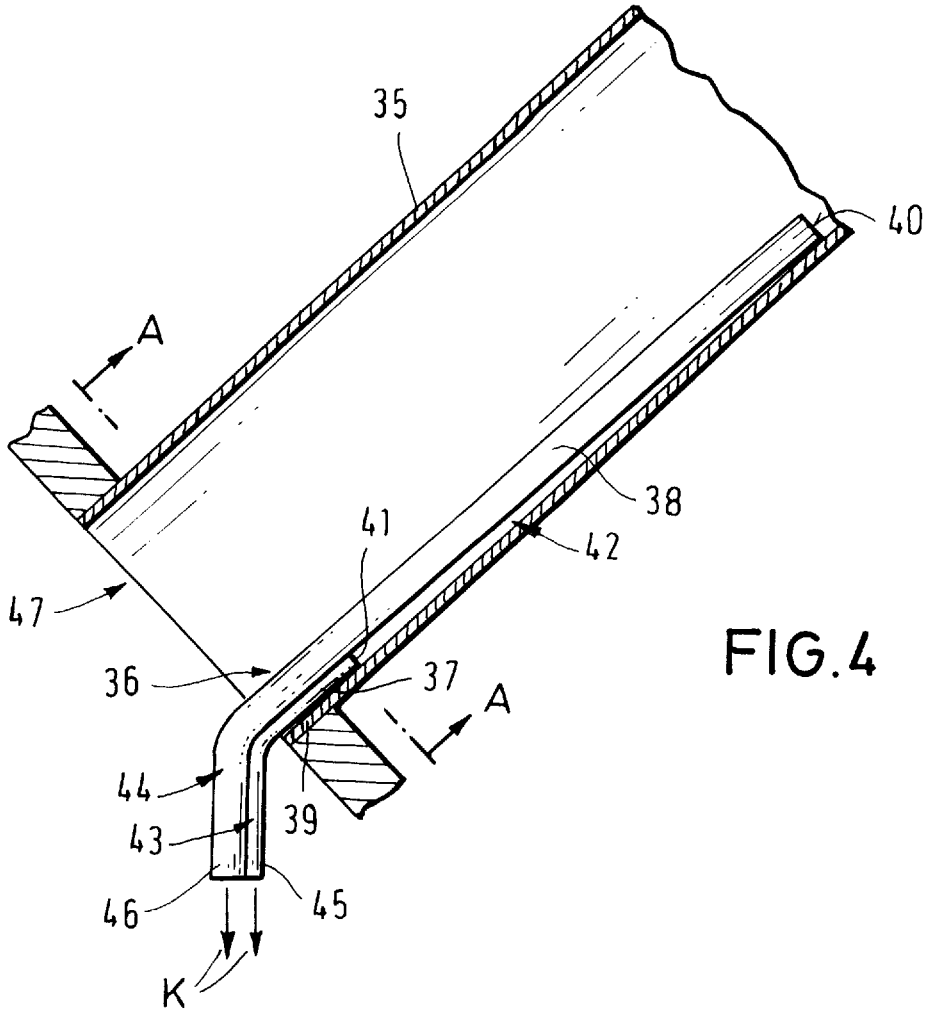
FIG. 4 is a view in vertical longitudinal section showing a section from a dephlegmator pipe illustrating the end on the steam inlet side.
Figure 5:
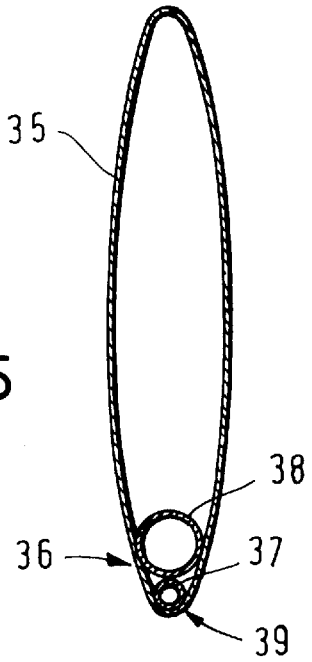
FIG. 5 shows a vertical cross section through the view shown in FIG. 4 along line A—A.

FIGS. 4 and 5 show an oval dephlegmator pipe 35 with a condensate outlet 36 which is formed by two pipes 37, 38 of different length. The shorter pipe 37 is arranged below the longer pipe 38 and rests on the lower longitudinal side 39 of the dephlegmator pipe 35. Pipe 38 extends farther upward until it likewise contacts the longitudinal side 39 of the dephlegmator pipe 35.

The condensate coming from the upper longitudinal portion of the dephlegmator pipe 35 is conducted off via pipe 38. The condensate coming from the lower longitudinal portion of the dephlegmator pipe 35 passes through pipe 37 into the steam-distributor and condensate-collecting chamber 22 (se FIG. 3). The condensate flows between the inlet 40 of pipe 38 and the inlet 41 of pipe 37 into the gap 42 formed below the pipe 38. It is extensively protected in that location against the friction of the upward flowing steam.

At its lower ends 43, 44, the pipes 37, 38 are bent downward and project into the steam-distributor and condensate-collecting chamber, not shown. In this way, a runoff 45, 46 is formed for the condensate K which is shifted from the region of the inlet opening 47 of the dephlegmator pipe 35.

As can be seen particularly from FIG. 5, the diameters of pipe 37 and pipe 38 have different dimensions and are adapted to the geometry of the oval dephlegmator pipe 35.

Figure 6:
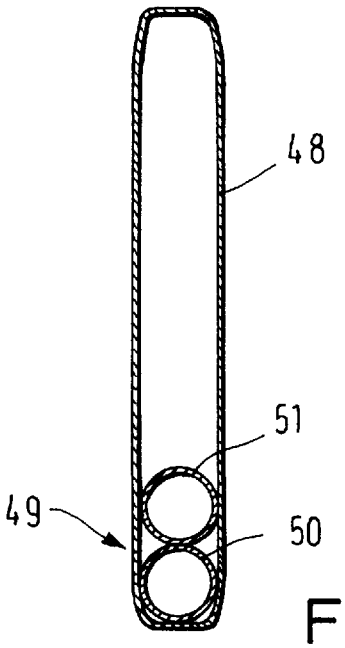
FIG. 6 shows a vertical cross section through the lower end of another embodiment form of a dephlegmator pipe.

FIG. 6 shows a rectangular dephlegmator pipe 48. In this case, also, a condensate outlet 49 is provided which comprises two pipes 50, 51 arranged one above the other. The diameter of the two pipes 50, 51 is identical. In other respects, the embodiment form basically corresponds to that described with reference to FIG. 4.

Figure 7:
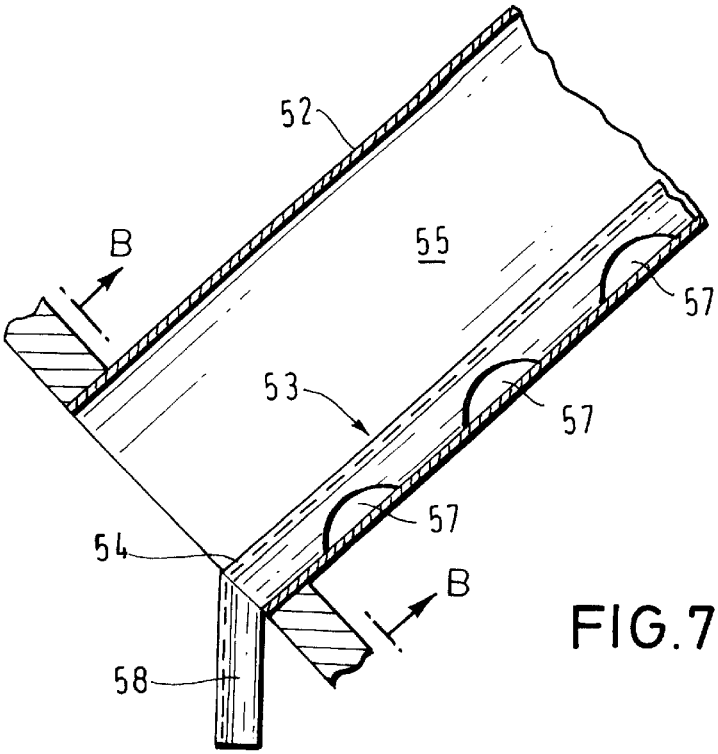
FIG. 7 shows a vertical longitudinal section through the lower end of a round dephlegmator pipe.
Figure 8:
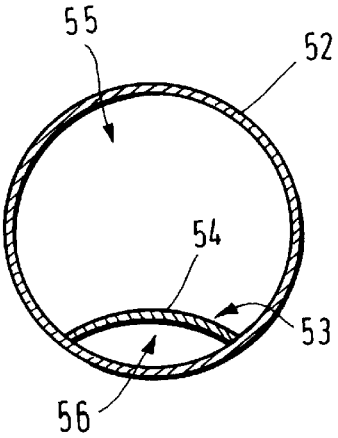
FIG. 8 shows a vertical cross section through FIG. 7 along line B—B.
Figure 9:
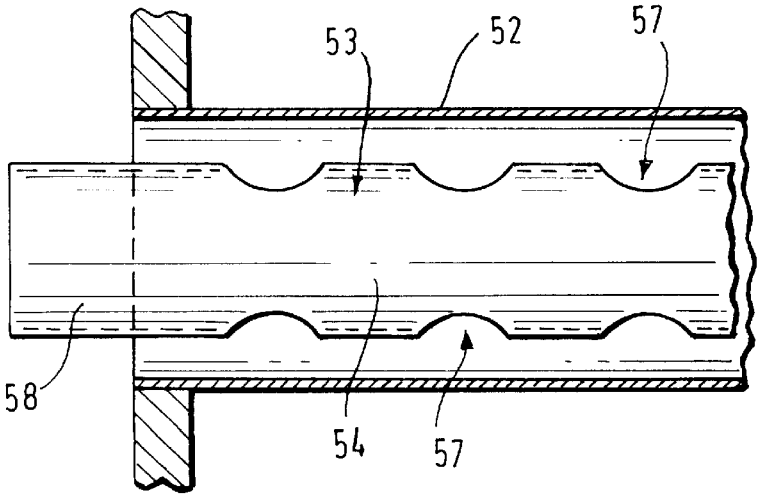
FIG. 9 shows the view from FIG. 7 from the top.

FIGS. 7 to 9 show a dephlegmator pipe 52 with a condensate outlet 53 which is formed by a dividing wall 54 incorporated in the dephlegmator pipe 52. The dephlegmator pipe 52 is divided into a steam channel 55 and a condensate channel 56 by the dividing wall 54. The dividing wall 54 is at most approximately half of the length of the dephlegmator pipe 52 or appreciably shorter than half, e.g., only 100 mm to 500 mm, because the highest shearing forces between the steam and condensate occur precisely in this region.

Recesses 57 for the passage of the condensate are distributed along the length of the dividing wall 54. The downward flowing condensate passes through the recesses 57 into the condensate outlet 53 and is guided out of the dephlegmator pipe 52 so as to be protected from the steam until exiting into a condensate collecting chamber via the runoff 58 which is likewise nose-shaped.

It can be seen from FIG. 8 that the dividing wall 54 is formed by a round plate. However, it is also possible, in principle, to form the dividing wall corresponding to the respective cross section geometry of a dephlegmator pipe by a flat or bent plate which is incorporated in a dephlegmator pipe.

Figure 10:
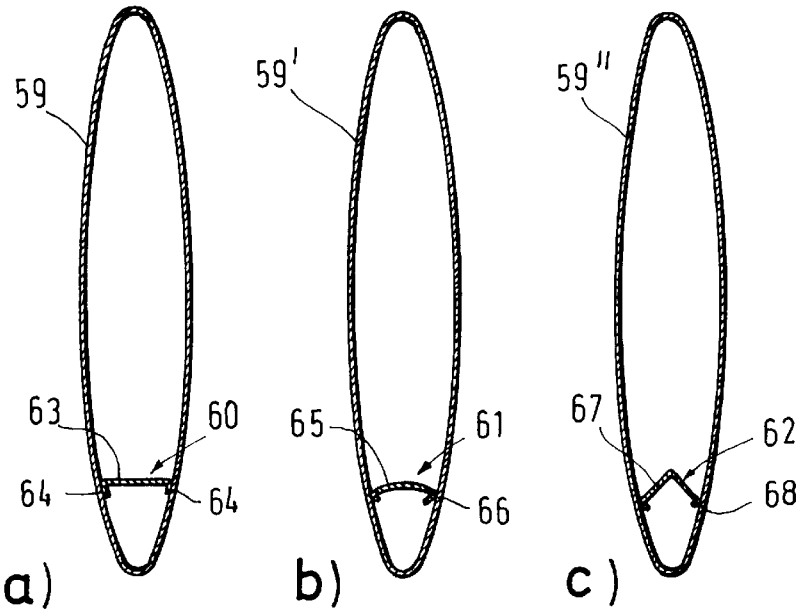
FIGS. 10*a–c* show a vertical cross section through the lower end of a dephlegmator pipe with illustrations of three additional constructions of a condensate outlet.

Illustrations a to c in FIG. 10 show dephlegmator pipes 59, 59', 59" with differently formed dividing walls 60, 61, 62 by way of example.

The dividing wall 60 is formed of a flat plate 63 with laterally arranged clamping legs 64. The dividing wall 60 is secured in the dephlegmator pipe 59 by means of the clamping legs 64.

In a modification of the latter, the dividing wall 61 is formed of a rounded plate 65 with lateral clamping legs 66 and the dividing wall 62 is formed of a hat-shaped plate 67 which is likewise secured in the dephlegmator pipe 59" by lateral clamping legs 68. Bore holes or cut out portions can be arranged in the dividing walls 60–62 for the passage of the condensate into the condensate outlet.

Figure 11:
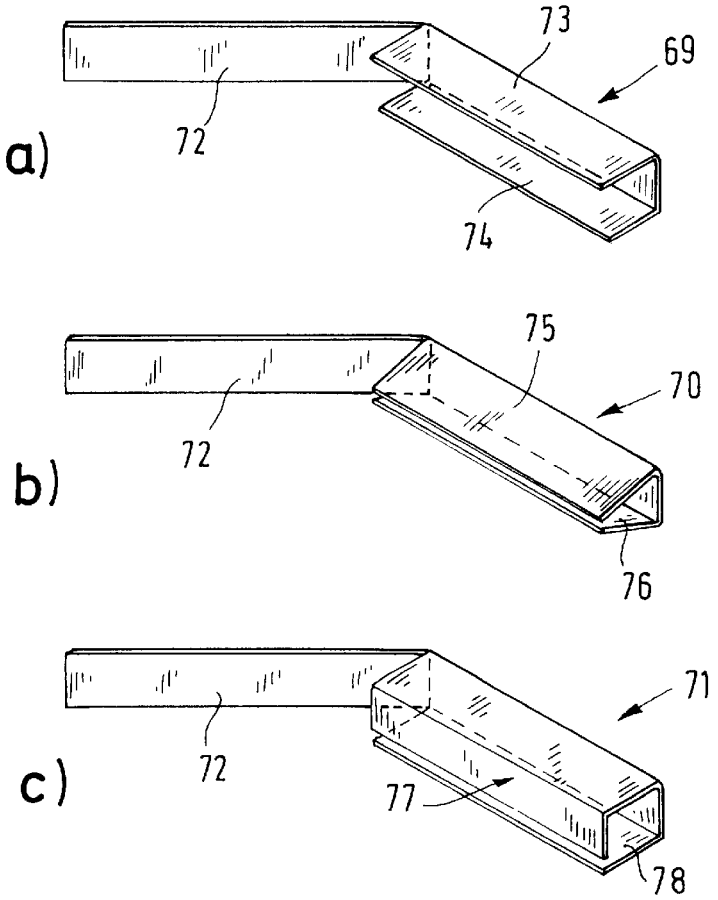
FIGS. 11*a–c* show three alternative construction possibilities for the runoff of a condensate outlet.

Three different embodiment forms of a condensate runoff 69, 70, 71 are shown by the illustrations in FIGS. 11*a*–*c*. Each of the condensate runoffs 6–71 is connected to a plate 72, shown in simplified form, which is incorporated in a dephlegmator pipe and thus ensures a condensate outlet for guiding off the condensate downward so as to be separated from the upward flowing steam.

The runoff 69 is U-shaped, wherein the downward oriented side walls 73, 74 in a steam-distributor and condensate-collecting chamber ensure a shielding of the condensate from the flowing steam.

A more extensive shielding of the condensate from the steam is provided by runoffs 70 and 71 in which the side walls 75, 76 and 77, 78, respectively, are joined in a triangular or box-shaped manner.

I claim:

1. Air-cooled surface condenser, comprising:

condenser pipes arranged at an inclination and having a first end region coupled to a steam-distributor chamber;

a steam-distributor and condensate-collecting chamber spaced from said steam-distributor chamber and coupled to a second opposite end region of said condenser pipes;

at least one dephleamator pipe connected in dephlegmator operation having a lower longitudinal side, a first end region connected to said steam-distributor and condensate-collecting chamber, and a second end region connected to a gas discharge; and a condensate outlet formed from a separate condensate conduit disposed within the dephleamator pipe and extending from the first end region towards the second end region of the dephleamator pipe.

2. Surface condenser according to claim 1, wherein the condensate outlet has a runoff projecting into the steam-distributor and condensate-collecting chamber.

3. Surface condenser according to claim 2, wherein the condensate outlet is arranged on the lower longitudinal side of the dephlegmator pipe.

4. Surface condenser according to claim 1, wherein the condensate outlet is arranged on the lower longitudinal side of the dephlegmator pipe.

5. Surface condenser according to one of claims 1 to 4, wherein the condensate outlet comprises at least one pipe which is incorporated in the dephlegmator pipe.

6. Surface condenser according to claim 5, wherein the condensate outlet is formed by two pipes of different length and the shorter pipe is arranged below the longer pipe.

7. Surface condenser according to one of claims 1 to 4, wherein the condensate outlet is formed by a dividing wall incorporated in the dephlegmator pipe.

8. Surface condenser according to claim 7, wherein recesses for the passage of condensate are provided so as to be distributed along the length of the dividing wall.

* * * * *